United States Patent [19]

Davidson

[11] 3,962,735

[45] June 15, 1976

[54] MOVABLE BULKHEAD WITH GUIDING AND OVERCANTING PREVENTION MEANS

[76] Inventor: Dekkers H. Davidson, 420 Nanyhagen Road, Thornwood, N.Y. 10594

[22] Filed: Dec. 28, 1973

[21] Appl. No.: 429,093

[52] U.S. Cl. ..... 4/172.12; 4/172.14

[51] Int. Cl.[2] ..... E04H 3/16; E04H 3/18

[58] Field of Search ..... 4/172, 172.11, 172.15, 4/172.19, 172.12, 172.14; 16/106; 104/244.11, 245, 247

[56] References Cited

UNITED STATES PATENTS

| | | | |
|---|---|---|---|
| 1,825,468 | 9/1931 | Miller | 104/247 |
| 3,098,454 | 7/1963 | Maestrelli | 104/130 |
| 3,241,157 | 3/1966 | Baker et al. | 4/172.11 |
| 3,423,768 | 1/1969 | Glenn | 4/172.13 |
| 3,423,768 | 1/1969 | Glenn | 4/172.13 |
| 3,467,028 | 9/1969 | James | 105/376 |
| 3,564,622 | 2/1971 | Meulekamp | 4/172.13 |
| 3,582,999 | 6/1971 | Baker | 4/172.11 |
| 3,842,484 | 10/1974 | Stark | 4/172 X |

*Primary Examiner*—Richard E. Aegerter
*Assistant Examiner*—James E. Bryant, III

[57] ABSTRACT

A bulkhead for a swimming pool, movable to selected positions along the length of the pool to divide the same into various activity areas, is provided with alignment means for preventing overcanting and jambing, such means being electrically conductive for contacting electrically conductive portions of the pool sides for bonding or grounding the bulkhead. Such a bulkhead for extra wide pools is provided with mid support and floatation elements compatible with the alignment and grounding means.

16 Claims, 6 Drawing Figures

MOVABLE BULKHEAD WITH GUIDING AND OVERCANTING PREVENTION MEANS

BACKGROUND OF THE INVENTION

Movable bulkheads for selectively dividing swimming pools into different length activity areas can present difficult alignment problems, as both ends of a relatively long bulkhead must be moved substantially at the same rate of movement if canting and possible jambing of the bulkhead against the pool sides in the canted position with consequent damage to the bulkhead and pool is to be prevented.

In this last respect, it has been proposed that the rollers, which may support the bulkhead on the gutters of the pool, be provided with vertical flanges to assure alignment of the bulkhead during movement along the length of the pool. However, it has been found that when the bulkhead becomes canted, the flanges actually act as wedges against the gutters.

The alignment problem becomes more critical with the lengthening of the bulkhead to accommodate wide pools, constructed, for instance, for side to side activities in pool areas divided by a bulkhead. In such bulkhead constructions, because of their weight, it has been suggested that mid-support between the bulkhead and the pool floor may be required. Such supports present bulkhead movement problems resulting from pool depth, support drag (the latter adding to the alignment problem), and the like. Similar movement problems arise when a double bulkhead (side by side bulkheads) for multiple pool area divisions are desirably moved simultaneously.

With the advent of the large (long) heavier bulkheads, flotation devices have been thought to be desirable. Here again such devices must be compatible with any alignment means devised for the bulkhead.

Furthermore, it has not been appreciated by bulkhead manufacturers, who normally use electrically conductive materials in the fabrication thereof, that such apparatus about and in a swimming pool area should be grounded, or at least bonded.

OBJECTS OF THE INVENTION

With respect to the problems created by the provision of flanged roller supports for the bulkhead and its attendant problems, it is an object of this invention to provide separate alignment elements, preventing overcanting, such elements, instead of the bulkhead, absorbing the canting forces, and which are easily released from the jambed position, should that occur.

It is a further object of this invention to minimize the alignment problem, and at the same time provide constant grounding of the bulkhead in an unobtrusive manner, by providing alignment means at the ends of the bulkhead, which means are electrically conductive, and which may be in constant contact with electrically conductive portions of the pool.

It is also an object of the invention to provide a bulkhead with mid-support which is compatible with the separate alignment elements of the invention. Similarly, flotation devices minimizing the weight of the bulkhead are provided in accordance with the object of the invention, which are compatible with the alignment elements.

The invention will best be understood upon reading the following specification with reference to the drawings, in which.

Figure 1:
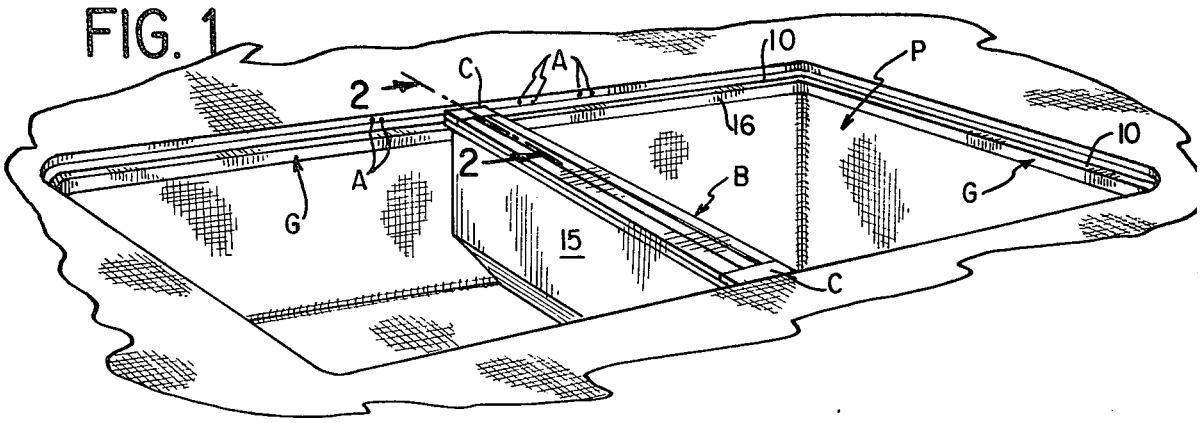
FIG. 1 is a top perspective view, showing a bulkhead positioned in a pool.
Figure 2:
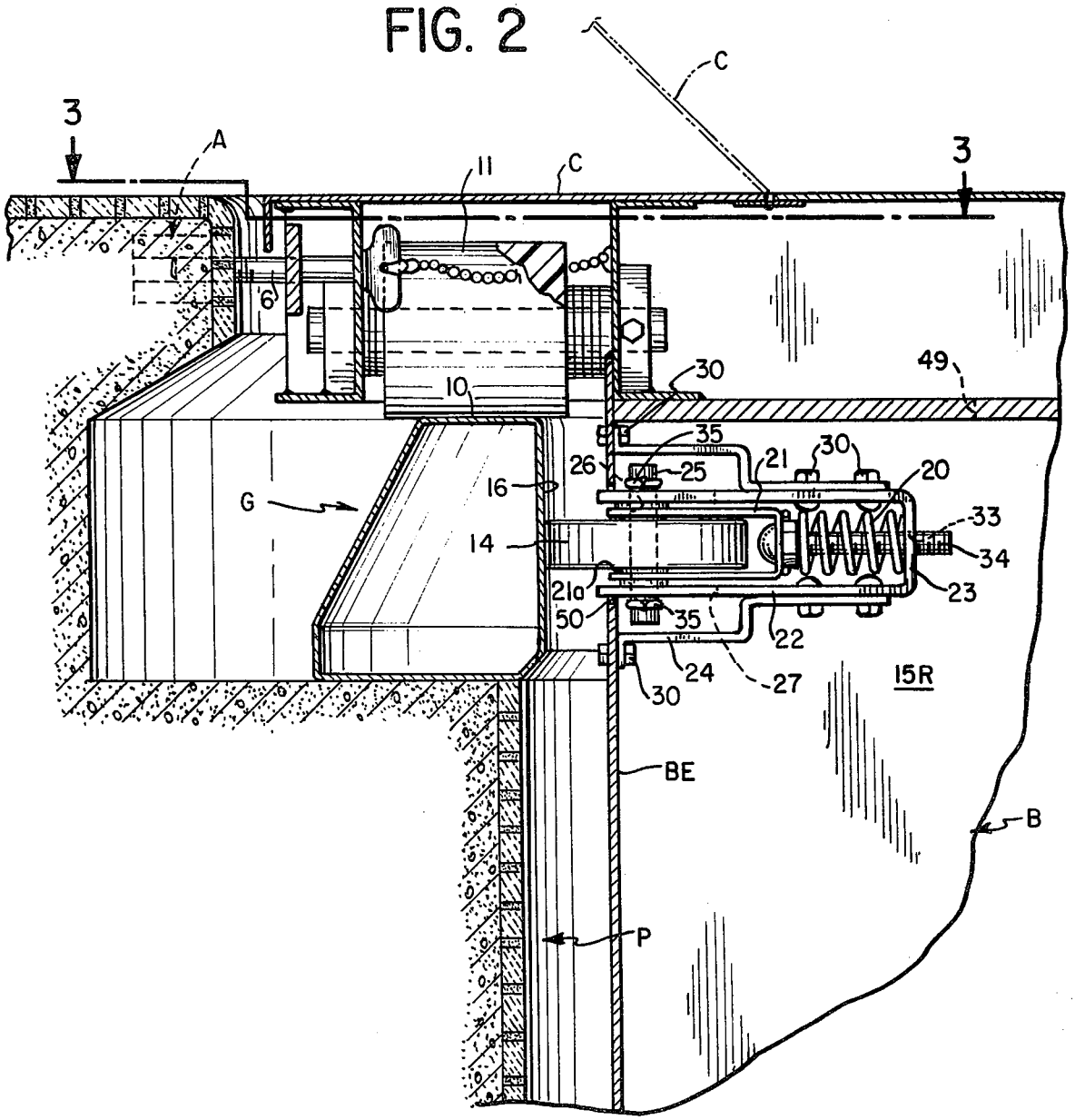
FIG. 2 is a sectional view, taken along the line 2—2 of FIG. 1.

The pool P provides a metal gutter G around the periphery of the swimming and diving areas. A bulkhead B is supported on the gutter edge 10 (FIG. 2) via rollers 11 rotatable about horizontal axes and normally made of a tough thermoplastic material, such as nylon, to minimize wear on the gutter. The rollers, as previously explained, are flangeless. Two are provided at each end of the bulkhead beneath a hinged cover C for maintenance and for visual orientation for the operators while moving the bulkhead.

Figure 3:
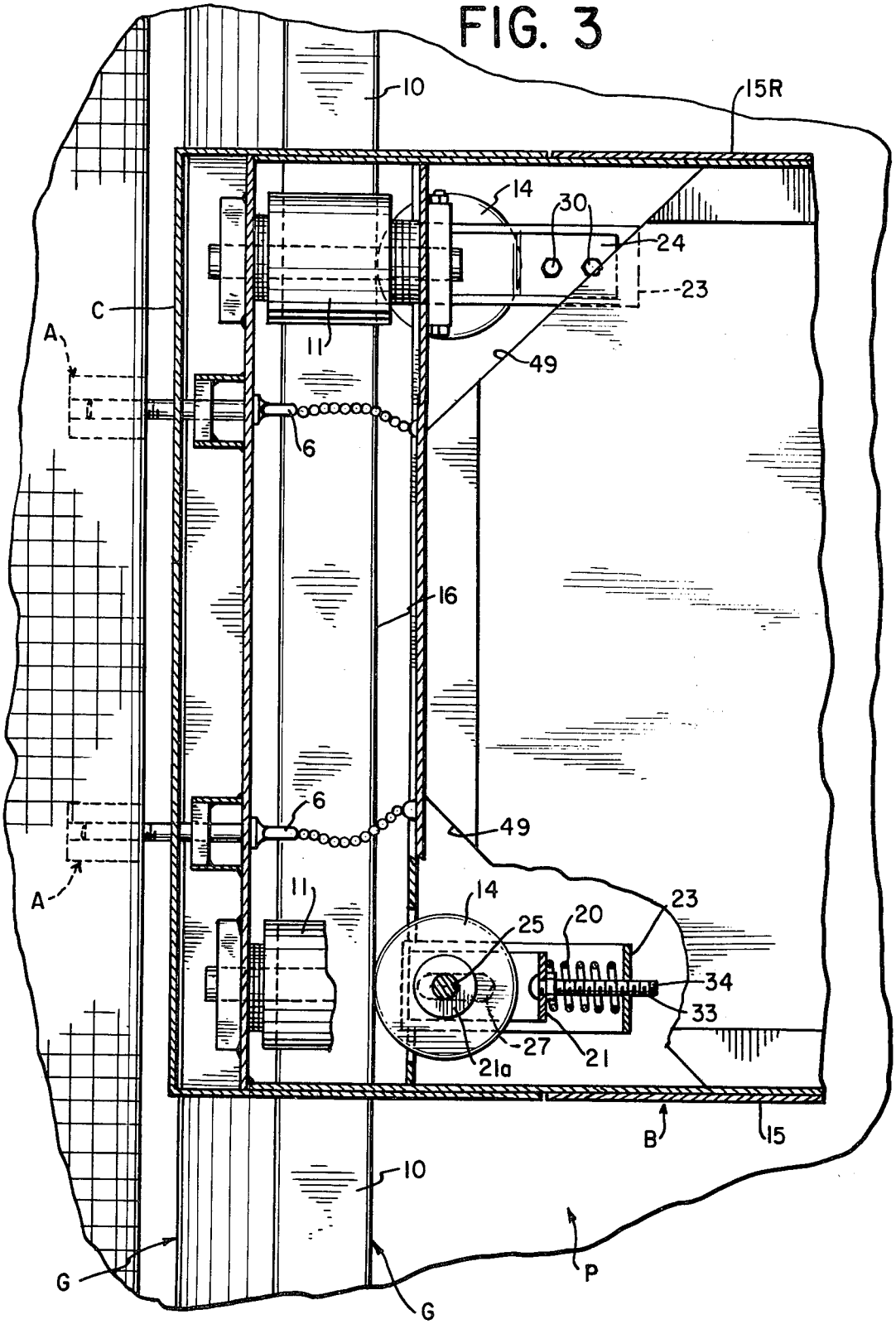
FIG. 3 is a top view, in section, taken along the line 3—3 of FIG. 2.

Anchor receiving stations A (FIG. 3) are positioned along both inner side walls of the pool P at preselected points for receiving anchor elements 6 which secure the bulkhead and pool sides against relative movement. The anchor elements 6 are moved into and out of engagement with the receiving stations A by an operator, access to the elements being provided through the door opening. (The details of construction thereof not forming part of this invention).

Below the rollers 11 and at both ends of the bulkhead, preferably a pair of stainless steel or aluminum wheels 14 are provided, one near the forward wall 15 and one near the rearward wall 15R of the bulkhead, access to which may be provided as shown, through a cut out portion 49 in bulkhead roller support floor 50. Each pair of wheels 14 are rotatable about vertical axes and protrude beyond the ends of the bulkhead through apertures 51.

The wheels 14 are kept in constant contact with the pool gutter edge 16 of the gutter G via springs 20 acting against the closed ends of U-shaped brackets 21, supporting the wheels 14, and against the bases 23 of sleeves 22 within which brackets 21 are free to slide.

The sleeves 22 are held fast to the bulkhead ends BE via internal brackets 24. Fasteners 30 which may be adjustable for installation purposes, connect the brackets, bulkhead and sleeves in conventional fashion.

The wheels are journalled for rotation about metal shafts 25 and the ends of the shafts may be rigidly fit or rotatable within holes 26 in the arms of U-shaped brackets 21 and ride in slots 27 in sleeves 22 when the wheels are depressed inwardly against spring 20 during canting of the bulkhead (depressed position of the wheels shown in FIGS. 2 and 3) and are pushed outwardly by springs 20 during alignment. The length of the slots 27 (identical on either side of the sleeves 22) assures that the wheels will always protrude past the ends of the bulkhead to avoid bulkhead-pool contact, much less jambing.

Suitable washer bearings, 21a, may be provided between wheels 14 and U-shaped brackets 21 to minimize friction therebetween. Cotter pins 35 are provided at the ends of shafts 25 to retain the shafts against excessive vertical movement. Guide and follower pins 34 connecting the U-shaped brackets 21 and riding in holes 33 centrally of the base 23 of sleeves 22 provide further stability to the wheel assembly. The wheels 14, brackets 21 and 24, sleeves 22, fasteners 30 and bulkhead ends BE (as well as the other bulkhead parts) are all metal.

Thus, the wheels 14 and their assemblies (though bars could be used instead) absorb the canting forces, should any occur during movement of the bulkhead, and assures a minimum of surface to surface contact between the pool gutter 10 and bulkhead structure B during canting.

Figure 4:
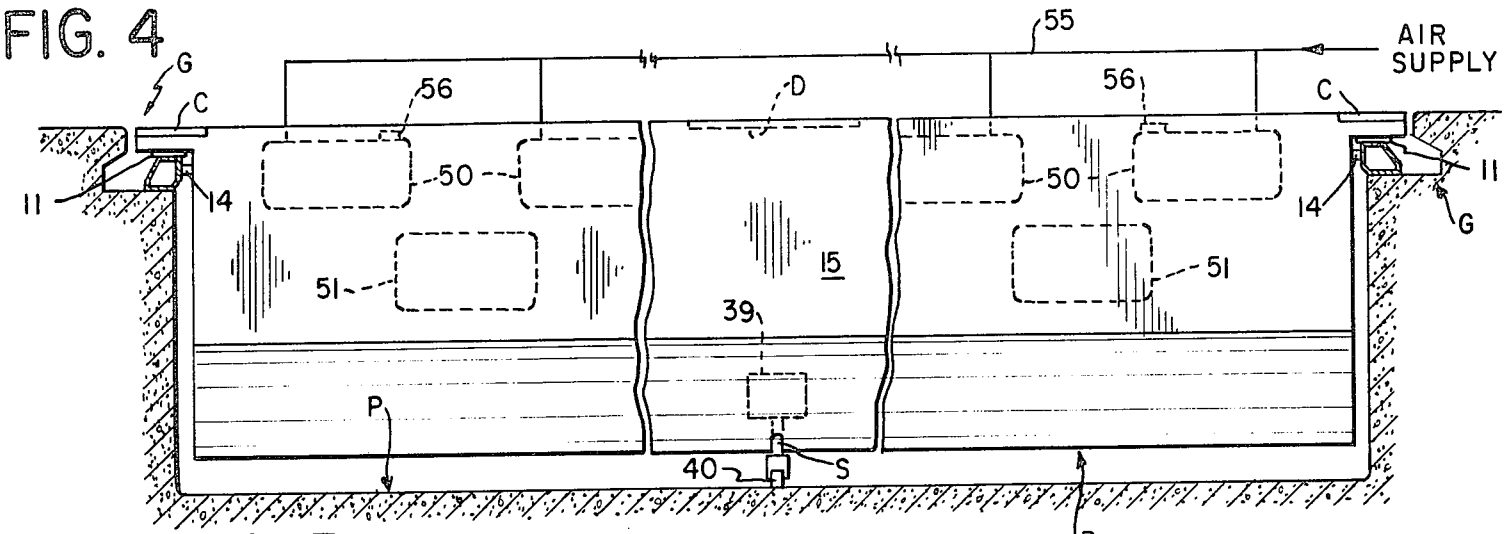
FIG. 4 is a diagrammatic front elevational view of a bulkhead provided with mid-support and flotation means.

FIG. 4 shows, diagrammatically, a bulkhead with a center support S which may comprise a foot 40, the leg of which is threadedly engaged (or otherwise vertically positionable) with any conventional lifting and lowering mechanism 39, access to which may be provided via door D for operating the same. The foot of support S may be a roller and the mechanism may provide sensing means for sensing pressure as the foot rides up grade, or sensing release of pressure as the foot leaves the floor 41 of the pool; and with means for automatically lifting and lowering the support to maintain a predetermined support pressure between the pool floor and the bulkhead.

In any event, means must be provided to lift the support from pool-floor interference during movement of the bulkhead so that such support will not lift the bulkhead off the rollers and cause further canting problems which wheels 14 cannot overcome and/or become misaligned with face 15.

The bulkhead of FIG. 4 also provides flotation devices 50, 51 for use with long and therefore heavy bulkheads so that moving the bulkhead will not become a burdensome chore for, for instance, two operators, one on either side of the pool.

Variable flotation devices 50 are, basically, inverted stainless steel boxes having at their closed upper ends fluid pressure introduction lines 55 for relieving the bulkhead of in-water weight; and pressure relief valves 56 (automatically or manually adjustable) to return in-water weight to the bulkhead.

Non-variable flotation devices 51 may be stainless steel encased styrofoam and provide in-water weight stability.

Figure 5:
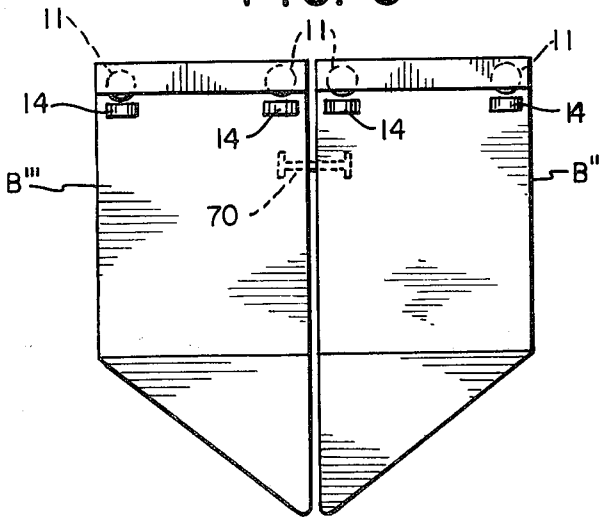
FIG. 5 is a diagrammatic side elevation view of a double bulkhead.

FIG. 5 merely shows a pair of bulkheads B″ and B‴ diagrammatically which may incorporate the various structures described above and their positioned relationships to one another. Double bulkheads clearly present a weight problem when connected via connections 70 and are to be moved along the pool sides at the same time.

It should be noted that the metal gutter used in pool constructions of the type described may be advantageously grounded through its own plumbing connections or may be otherwise grounded. Where ceramic gutters are used, a grounding strip of electrically conductive material, properly grounded may be provided around the periphery of the pool.

Figure 6:
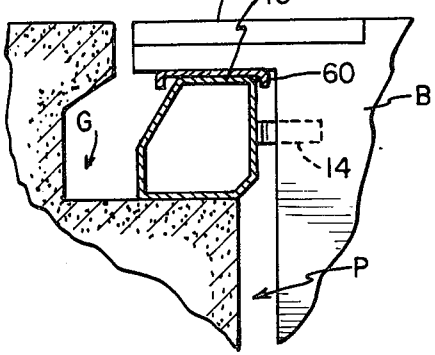
FIG. 6 is a diagrammatic elevational view of a bulkhead supported by skids made possible because of the alignment means of the invention.

Incidental to the provision of the guiding means of the invention, disposed below the bulkhead supports (rollers 11) it now becomes feasible to eliminate rollers in favor of studs 60 (FIG. 6) having Teflon bearing surfaces for sliding the bulkhead along the gutter rim, thus eliminating maintenance problems consonant with shaft supported rollers. Such skids, because of their lineal dimension, might add to the jambing problem were it not for the provision of the guiding means.

The invention has been described with reference to specific disclosed constructions. Those skilled in the art will now conceive of variations and modifications of the invention as described to bring about the same results. Thus, the invention is not to be limited herein only to such specific constructions but to what is now claimed.

I claim:

1. A moveable bulkhead, for use in a swimming pool having rail means along the upper periphery of the sides thereof, for extending across and dividing the pool into separate activity areas, said bulkhead having forward and rearward walls and means for mounting the same in spaced relation means positioned intermediate the ends of said forward and rearward walls for supporting said bulkhead upon the upper surface of the rail means while stationary thereon and while being moved therealong, the improvement comprising means separate and remote from said supporting means for guiding and preventing over-canting of said bulkhead as it is moved, for preventing the ends of said forward and rearward walls from contacting the sides of the pool, said guiding and preventing means including means for mounting the same adjacent the ends of said forward and rearward walls, said guiding and preventing means extending from said mounting means for substantially constant contact against the sides of the pool.

2. The moveable bulkhead of claim 1 for use in a pool having electrically conductive means along the sides thereof and wherein said bulkhead is made of electrically conductive material, said guiding and preventing means being electrically conductive and means are provided for electrical connection between said guiding means and said electrically conductive material of said bulkhead, and said mounting means includes means for continuously and positively biasing said guiding and preventing means against the sides of the pool for electrical contact against the electrically conductive means along the sides of the pool.

3. The bulkhead of claim 2 for use in a pool having the rail means and electrically conductive means along the sides of the pool constituting the gutter rail of the pool, and wherein said guiding and preventing means is continuously and positively biased against the gutter rail.

4. A moveable bulkhead, for use in a swimming pool having rail means along the upper periphery of the sides thereof, for extending across and dividing the pool into separate activity areas, said bulkhead having forward rearward walls and means positioned intermediate the ends of said forward and rearward walls for supporting said bulkhead upon the upper surface of the rail means while stationary thereon and while being moved therealong, the improvement comprising means for guiding and preventing over-canting of said bulkhead as it is moved, for preventing the ends of said forward and rearward walls from contacting the sides of the pool, said guiding and preventing including means for mounting the same adjacent the ends of said forward and rearward walls, said guiding and preventing means extending from said mounting means for substantially constant contact against the sides of the pool and the bulkhead of claim 1 wherein said means for supporting said bulkhead comprise flangeless rollers and said guiding and preventing means are the sole means for guiding and preventing over-canting of said bulkhead as it is moved.

5. A moveable bulkhead, for use in a swimming pool having rail means along the upper periphery of the sides thereof, for extending across and dividing the pool into separate activity areas, said bulkhead having forward and rearward walls and means for mounting the same in spaced relation means positioned intermediate the ends of said forward and rearward walls for supporting said bulkhead upon the upper surface of the rail means while stationary thereon and while being moved therealong, the improvement comprising means for guiding and preventing over-canting of said bulkhead as it is moved, for preventing the ends of said forward and rearward walls from contacting the sides of the pool, guiding and preventing means including means for mounting the same adjacent the end of said forward and rearward walls, said guiding and preventing means extending from said mounting means for substantially constant contact against the sides of the pool and said means for supporting said bulkhead comprise skids.

6. A moveable bulkhead, for use in a swimming pool having rail means along the upper periphery of the sides thereof, for extending across and dividing the pool into separate activity areas, said bulkhead having forward and rearward walls and means for mounting the same at spaced relation means positioned intermediate the ends of said forward and rearward walls for supporting said bulkhead upon the upper surface of the rail means while stationary thereon and while being moved therealong, the improvement comprising means for guiding and preventing over-canting of said bulkhead as it as moved, for preventing the ends of said forward and rearward walls from contacting the sides of the pool, guiding and preventing means including means for mounting the same adjacent the ends of said forward and rearward walls said guiding and preventing means extending from said mounting means for substantially constant contact against the sides of the pool and centrally positioned between the ends of said bulkhead there are provided means for supporting said bulkhead upon the bottom of the pool, said means being vertically moveable for accommodating the contour of the pool bottom.

7. The bulkhead of claim 1 wherein there are provided flotation means for reducing the relative weight of said bulkhead in water.

8. The bulkhead of claim 7 wherein said flotation means include means for introducing and relieving fluid pressure thereto and therefrom.

9. The bulkhead of claim 1 wherein said guiding and preventing means include roller means for sustantially frictionless guiding movement thereof along the sides of the pool.

10. The bulkhead of claim 2 wherein said guiding and preventing means include roller means for substantially frictionless guiding movement thereof along the sides of the pool.

11. The moveable bulkhead of claim 4 for use in a pool having electrically conductive means along the sides thereof and wherein said bulkhead is made of electrically conductive material, said guiding and preventing means being electrically conductive and means are provided for electrical connection between said guiding and preventing means and said electrically conductive material of said bulkhead, and said mounting means includes means for continuously and positively biasing said guiding and preventing means against the sides of the pool.

12. The bulkhead of claim 11 for use in a pool having the rail means and electrically conductive means along the sides of the pool constituting the gutter rail of the pool, and wherein said guiding and preventing means is continuously and positively biased against the gutter rail.

13. The bulkhead of claim 4 wherein there are provided floatation means for reducing the relative weight of said bulkhead in water.

14. The bulkhead of claim 13 wherein said flotation means include means for introducing and relieving fluid pressure thereto and therefrom.

15. The bulkhead of claim 4 wherein said guiding and preventing means include roller means for substantially frictionless guiding movement thereof along the sides of the pool.

16. The bulkhead of claim 11 wherein said guiding and preventing means include roller means for substantially frictionless guiding movement thereof along the sides of the pool.

* * * * *